United States Patent [19]

Hirayama et al.

[11] Patent Number: 4,929,105

[45] Date of Patent: May 29, 1990

[54] PAPER FEEDING APPARATUS FOR PRINTER

[75] Inventors: Takanobu Hirayama, Chita; Hiroyuki Funahashi, Nagoya; Eiji Yokota, Nagoya; Mitsuyoshi Uehara, Nagoya; Isao Kagami, Nagoya; Makoto Hasegawa, Kasugai; Masaru Mizuno, Nagoya, all of Japan

[73] Assignee: Brother Kogyo Kabushiki Kaisha, Aichi, Japan

[21] Appl. No.: 355,072

[22] Filed: May 15, 1989

Related U.S. Application Data

[63] Continuation of Ser. No. 112,218, Oct. 26, 1987, abandoned.

[30] Foreign Application Priority Data

Oct. 31, 1986 [JP] Japan ..... 61-261425
Sep. 17, 1987 [JP] Japan ..... 62-141910[U]

[51] Int. Cl.[5] ..... B41J 11/42; B41J 13/10; B41J 13/26

[52] U.S. Cl. ..... 400/625; 271/225; 271/902; 400/568; 400/569; 400/582

[58] Field of Search ..... 400/368, 582, 625, 605, 400/624, 628, 631, 632, 630, 636, 636.1, 636.2, 569; 271/225, 902; 318/283, 284, 285

[56] References Cited

U.S. PATENT DOCUMENTS

| | | | |
|---|---|---|---|
| 4,403,878 | 9/1983 | Hosogaya | 400/605 X |
| 4,650,375 | 3/1987 | Millsap | 318/285 X |
| 4,680,513 | 7/1987 | Kennedy | 318/283 X |
| 4,687,362 | 8/1987 | Rünzi | 400/630 |
| 4,691,911 | 9/1987 | Nakagawa et al. | 400/605 X |

FOREIGN PATENT DOCUMENTS

| | | | |
|---|---|---|---|
| 0230507 | 8/1987 | European Pat. Off. | 400/624 |
| 57-1780 | 1/1982 | Japan . | |
| 0211479 | 12/1983 | Japan | 400/636.2 |
| 0154962 | 7/1986 | Japan | 400/624 |
| 44466 | 2/1987 | Japan | 400/630 |
| 122770 | 6/1987 | Japan | 400/630 |

*Primary Examiner*—Edgar S. Burr
*Assistant Examiner*—Moshe I. Cohen
*Attorney, Agent, or Firm*—Oliff & Berridge

[57] ABSTRACT

A paper feeding apparatus for the printer having an intermittent mechanism between a driving motor and both a paper feed roller and a platen. The intermittent mechanism allows both the platen and the paper feed roller to rotate simultaneously and also allows only the platen to rotate while the paper feed roller is suspended, so that a sheet of printing paper is set straight along the platen. When the rotational direction of the driving motor is reversed to reverse that of the platen, the driving motor stops rotating for a limited period. Under such conditions the sheet is fed properly in response to the rotation of the platen, being free from the inertia force of the sheet and from the platen's vibration.

6 Claims, 6 Drawing Sheets

PAPER FEEDING APPARATUS FOR PRINTER

This is a continuation of application Ser. No. 112,218 filed Oct. 26, 1987, now abandoned.

BACKGROUND OF THE INVENTION

This invention relates to a paper feeding apparatus which feeds a sheet of paper automatically to the platen of the printer.

This kind of the paper feeding apparatus is known by Japanese published unexamined patent application No. 57-1780, for example. It feeds a sheet of paper from the paper feed tray to a position on the platen of the printer by rotating forward the feed roller and the platen. Thereafter, the rotation of the feed roller is suspended so as to fix the sheet at one of its edges, and the platen is rotated backward so as to straighten a front edge of the sheet along the platen. Finally, both the feed roller and the platen are rotated forward again to feed the sheet to the printing position on the platen.

According to this conventional apparatus, a single paper feed motor rotates the platen and the feed roller forward as well as backward, and also suspends the rotation of the feed roller during the rotation of the platen. Therefore, a clutch mechanism is necessary between the motor and the feed roller, resulting in the complicated construction of the apparatus.

Another conventional paper feeding apparatus of this kind feeds forward a sheet of paper which is set between the platen and the paper guide roller, and then feeds it backward for a predetermined distance. As a result, a front edge of the sheet is brought into contact with a contact point of the platen and the paper guide roller so as to straighten the edge along the platen. When the feed direction of paper is reversed from forward to backward, a motor which has been rotated forward to rotate the platen is immediately rotated backward. Similarly, when the direction is reversed from backward to forward, the motor which has been rotated backward is immediately rotated forward.

According to the aforementioned second prior art, the inertia force of the sheet or the vibration of the platen, in response to the reverse action of the platen, may weaken the contacting pressure between the sheet and the platen. Accordingly, the sheet sometimes fails to follow the rotation of the platen and slips on the platen, resulting in inaccurate paper feed.

SUMMARY OF THE INVENTION

It is accordingly an object of the present invention to provide a paper feeding apparatus having an intermittent mechanism between a driving motor and a paper feed roller which allows the platen and the feed roller to rotate forward and backward, and which suspends the rotation of the feed roller during the rotation of the platen, so that a sheet of paper is set straight along the longitudinal direction of the platen by means of a simpler mechanism than the conventional clutch mechanism.

It is a further object to provide a paper feeding apparatus having a stepping motor which stops rotating for a predetermined period before reversing the direction of rotation, so that it can reduce the inertia force of a moved sheet of paper as well as the vibration of the platen, and thus, the sheet can be fed properly in response to the rotation of the platen.

The objects are attained by a paper feeder for a printing device having a motor for rotating a platen in normal and reverse direction, a paper feed roller activated by the motor via an intermittent mechanism for feeding a sheet of paper toward platen, the intermittent mechanism comprising; a first intermittent gear rotatably supported on a shaft and having a first gear portion which engages with a drive gear connected to the motor and a toothless portion which does not engage therewith, a second intermittent gear rotatably supported on the shaft 35 and having a second gear portion which engages with a gear of the paper feed roller and a toothless portion which does not engage therewith, engagement means for making an engagement between the first gear portion of the first intermittent gear and the drive gear, stop means for stopping the first intermittent gear such that the toothless portion thereof and the drive gear are opposed to each other, and rotation means for integrally rotating the first and second intermittent gears when the first intermittent gear is rotated in normal direction and for rotating at first only the first intermittent gear within a predetermined range and thereafter integrally rotating the first and second intermittent gear when said first intermittent gear is rotated in reverse direction.

The objects are also attained by a paper feeder for the printing device comprising; a driving roller activated by a motor which rotates in a normal direction and a reverse direction, a press roller in close contact with said driving roller, control means for feeding a sheet of paper which is held between said driving roller and said press roller in contact therewith to a position opposite to a printing head, and waiting means for stopping said motor during a predetermined time period when said rotational direction of said motor is reversed.

BRIEF DESCRIPTION OF THE DRAWINGS

The invention will now be described with reference to the accompanying drawings, in which.

DETAILED DESCRIPTION OF THE PREFERRED EMBODIMENTS

A paper feeding apparatus for a printer embodying the present invention will be described hereinafter according to the drawings.

Figure 2:
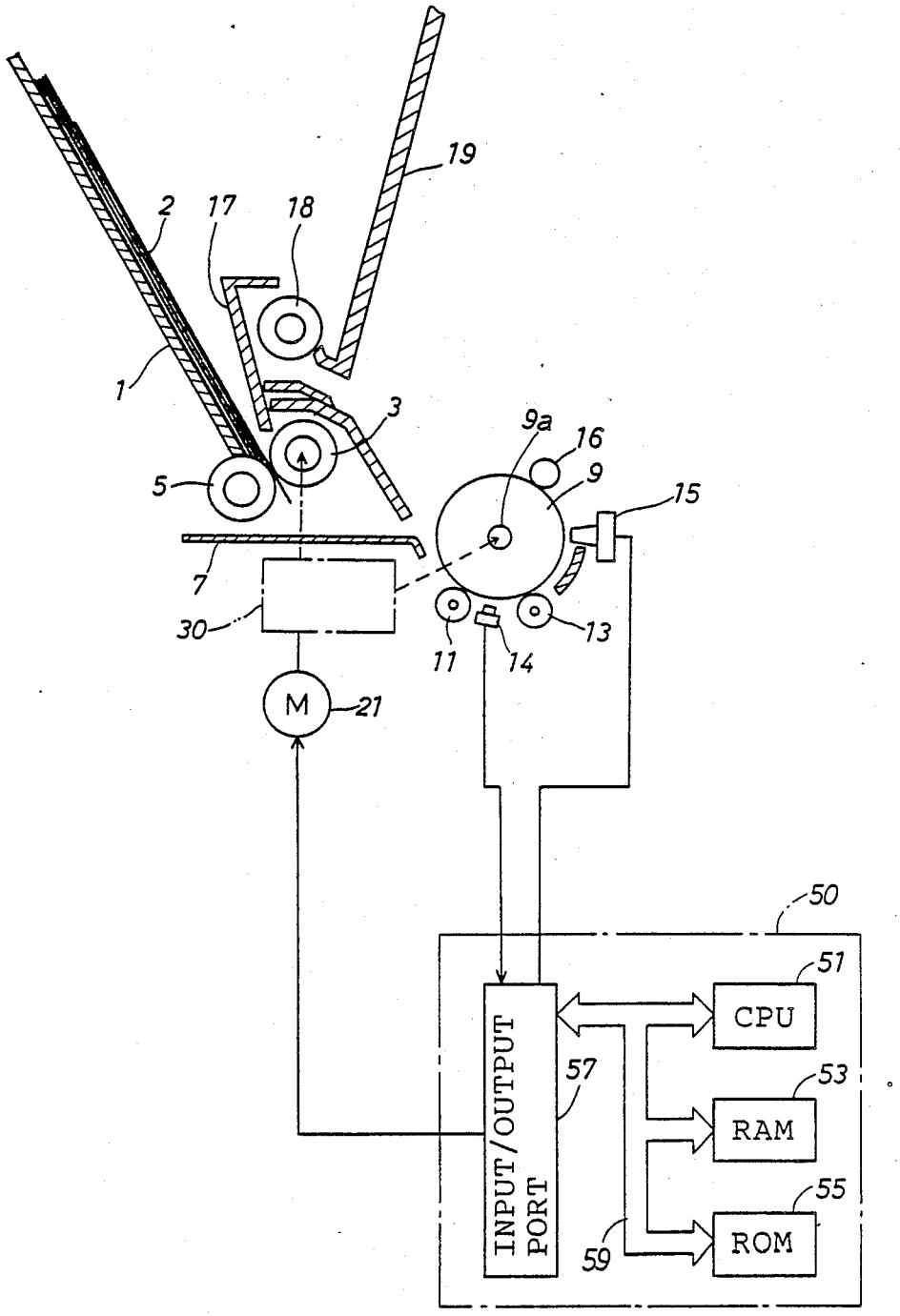
FIG. 2 is a schematic side view with a block diagram illustrating the paper feeding apparatus.

Referring to FIG. 2, a paper feed tray 1 is fixed on a printer case (not shown) for holding a pile of individual cut sheets 2. At the lower end of the paper feed tray 1, a paper feed roller 3 and a brake roller 5 are supported by both side boards of the printer case. On a paper path extending from the feed roller 3 and the brake roller 5, a guide member 7 is attached to the printer case, and a platen shaft 9*a* of a platen 9 is rotatably supported between the both side boards for operating as a driving roller. A rear paper guide roller 11 and a front paper guide roller 13 are provided in contact with the lower surface of the platen 9 so as to advance a sheet of paper 2 between the platen 9 and the rollers 11 and 13. Between the rollers 11 and 13 is disposed a paper detective sensor 14. In front of the platen 9, a print head 15 is disposed movably back and forth along the longitudinal direction of the platen 9. A paper bail roller 16 is disposed above the print head 15 so as to bring the sheet 2 into contact with the platen 9. A guide member 17 is provided on the paper path in such a manner that the sheet 2 moved from the platen 9 is discharged by a paper discharge roller 18 and then received by a paper stacker 19.

The paper feed roller 3 and the platen 9 are driven by a driving force of a stepping motor 21 for line feed (LF). The driving force is transmitted via a gear mechanism and an intermittent mechanism 30, shown in detail in FIG. 1.

The stepping motor 21 is controlled by an electronic control unit 50. The electronic control unit 50 as a control means comprises a well-known microcomputer; namely, a central processing unit (CPU) 51, a random access memory (RAM) 53, a read only memory (ROM) 55, an input/output port 57, and a common bus 59. The input/output port 57 converts an input/output signal from the external into a signal which can be manipulated by CPU 51.

Figure 1:
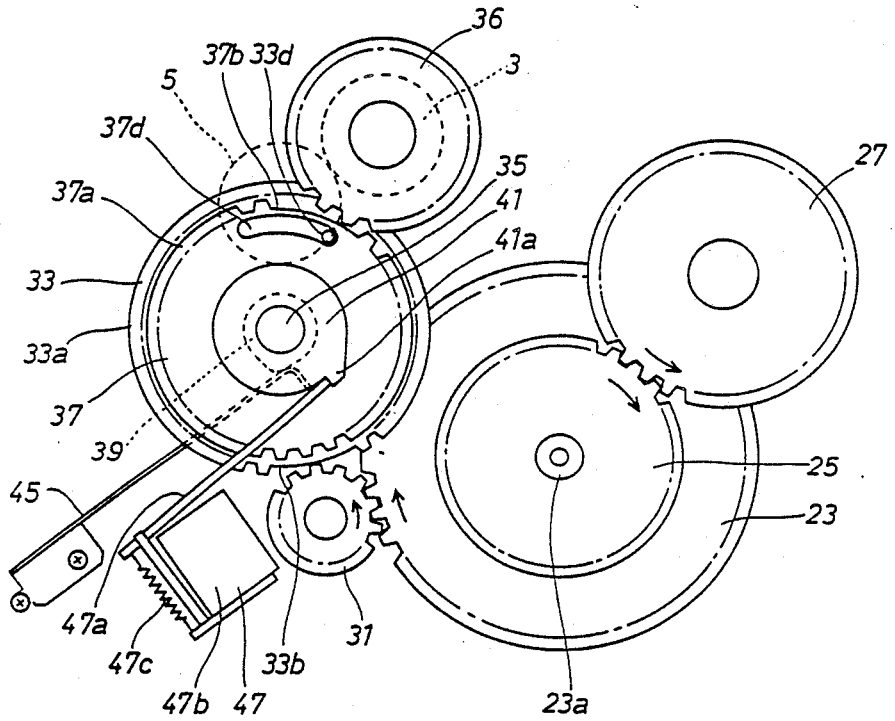
FIGS. 1, 4A and 4B are front views of an intermittent mechanism of a paper feeding apparatus for a printer as a first and a second embodiment of the present invention.

Referring to FIG. 1, the intermittent mechanism 30 will now be explained. A driving gear 31, connected directly with the stepping motor 21, always engages with a first driven gear 23. A shaft 23*a* of the first driven gear 23 is fixed with a second driven gear 25 which is operated in accordance with the first driven gear 23. The second driven gear 25 always engages with a platen gear 27.

Figure 3:
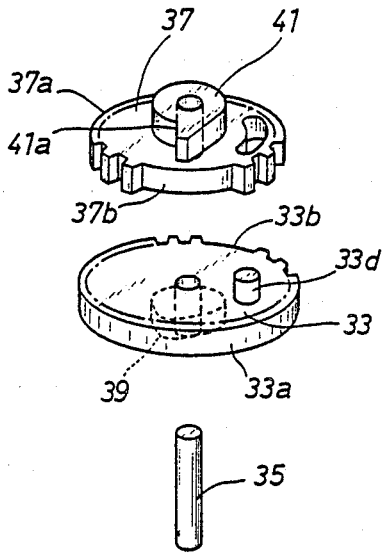
FIG. 3 is an exploded perspective view illustrating a main portion of the intermittent mechanism.

A first intermittent gear 33 is disposed opposite to the driving gear 31. The first intermittent gear 33 has a gear portion 33*a* and a toothless portion 33*b*. The gear portion 33*a* is provided to engage with the driving gear 31 while the toothless portion 33*b* does not engage therewith. FIG. 1 illustrates the first intermittent gear 33 with the toothless portion 33*b* opposite to the driving gear 31. A shaft 35 in the center of the first intermittent gear 33 supports a second intermittent gear 37, a press cam 39, and a stop cam 41. The second intermittent gear 37 comprises a gear portion 37*a* and a toothless portion 37*b*. The gear portion 37*a* is provided to engage with a paper feed gear 36 while the toothless portion 37*b* does not engage therewith. The first intermittent gear 33 is formed integrally with the press cam 39, while the second intermittent gear 37 is formed integrally with the stop cam 41. The first and second intermittent gears 33 and 37 are rotatably supported on the shaft 35. As shown in FIG. 3, a pin 33*d* is formed on the side surface of the first intermittent gear 33. The pin 33*d* is inserted into a slot 37*d* on the second intermittent gear 37 so as to be slid along the slot 37*d*.

Referring again to FIG. 1, an end portion of a plate spring 45 presses the press cam 39 to rotate it clockwise in the drawing. A working rod 47*a* of an electromagnetic device 47 is disposed with its end connected with a projecting portion 41*a* of the stop cam 41. The electromagnetic device 47 energizes a solenoid 47*b* to pull the working rod 47*a* against a spring 47*c*.

Now, a paper feed mechanism will be explained in detail with reference to FIGS. 1, 4A and 4B.

First, FIG. 1 illustrates a way of rotating the platen 9 forward while suspending the paper feed roller 3. When the solenoid 47*b* of the electromagnetic device 47 is not energized, the working rod 47*a* abuts on the projecting portion 41*a* of the stop cam 41 by means of the spring force of the spring 47*c*. Since the driving gear 31 engages with the first driven gear 23 in this case, the rotational motion is transmitted from the driving gear 31 to the platen gear 27 via the first driven gear 23, the shaft 23*a* and the second driven gear 25. As a result, the platen 9 is rotated forward, i.e., counterclockwise in the drawing. On the other hand, since the driving gear 31 is opposite to the toothless portion 33*b* of the first intermittent gear 33, the driving motion is not transmitted to the first intermittent gear 33. Similarly, since the paper feed gear 36 is opposite to the toothless portion 37*b* of the second intermittent gear 37, the rotational motion is not transmitted to the paper feed roller 3.

Figure 4A:
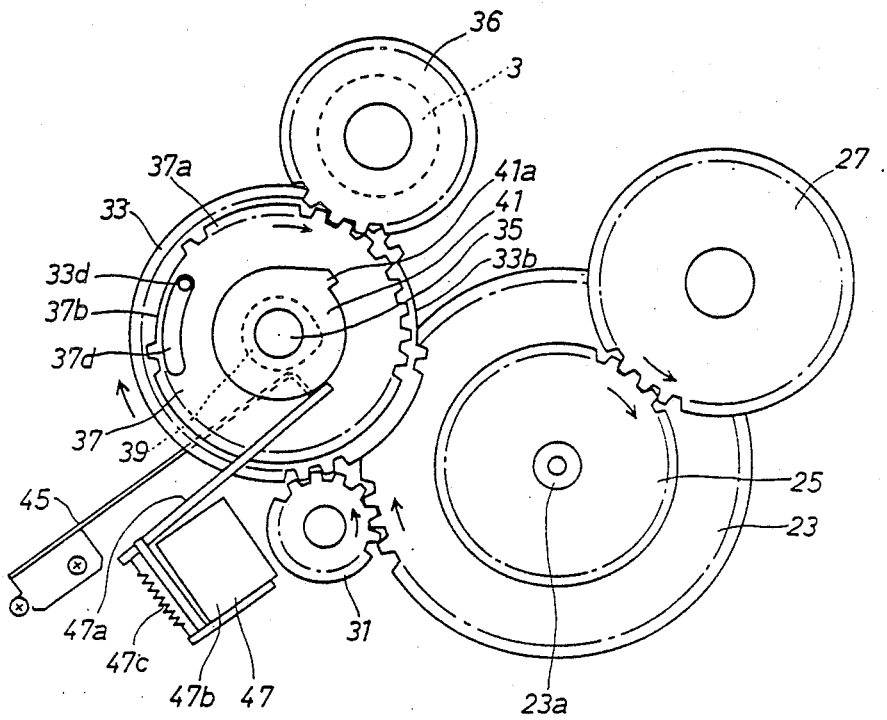

Second, FIG. 4A illustrates a way of rotating the platen 9 and the paper feed roller 3 forward. When the solenoid 47*b* of the electromagnetic device 47 is energized, the working rod 47*a* is pulled away from the projecting portion 41*a* of the stop cam 41 so as to rotate the press cam 39 clockwise from the end of the plate spring 45. The rotation of the press cam 39 accordingly rotates the first intermittent gear 33 clockwise around the shaft 35, resulting in the engagement of the gear portion 33*a* of the first intermittent gear 33 with the driving gear 31. Thereafter, the rotation of the first intermittent gear 33 is transmitted to the second intermittent gear 37 via the pin 33*d* and one end portion of the slot 37*d* so as to rotate the second intermittent gear 37 clockwise. Thus, the second intermittent gear 37 engages with the paper feed gear 36. Thereafter, the working rod 47*a* is connected with the projecting portion 41*a* again by means of the spring force of the spring 47*c*, as shown in FIG. 1.

In the same way as described in the first case with reference to FIG. 1, the forward rotation of the stepping motor 21, in this second case, also rotates the platen 9 forward via the driving gear 31, the first driven gear 23, the shaft 23*a*, the second driven gear 25 and the platen gear 27. Furthermore, the rotation of the stepping motor 21 rotates the paper feed roller 3 forward, i.e., counterclockwise in the drawing, via the driving gear 31, the first intermittent gear 33, the pin 33*d*, the end portion of the slot 37*d*, the second intermittent gear 37 and the paper feed gear 36.

Figure 4B:
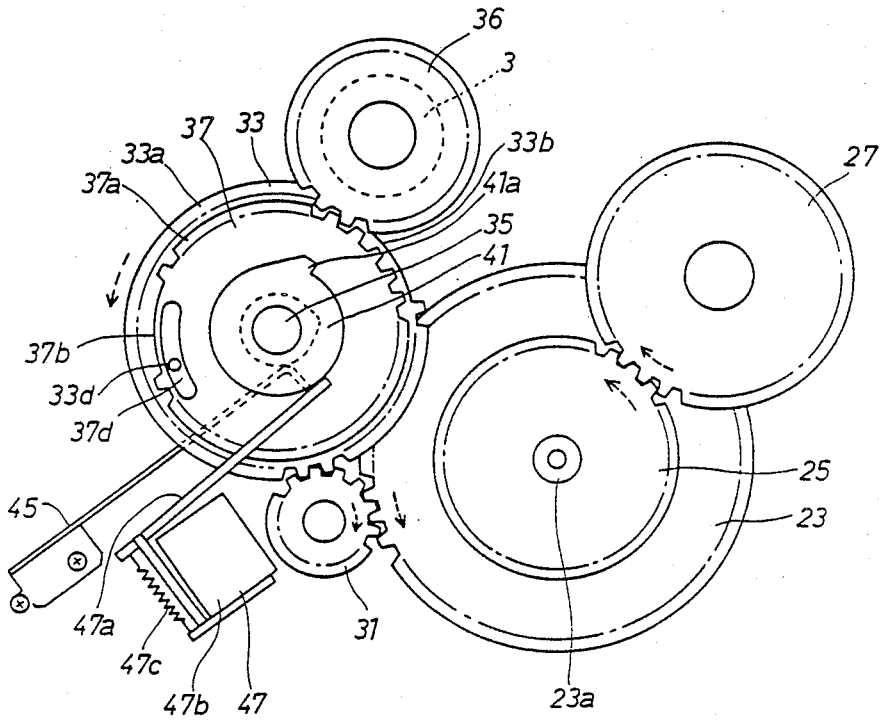

Third, FIG. 4B illustrates a way of rotating only the platen 9 backward while suspending the paper feed roller 3. When the stepping motor 21 is rotated backward so as to rotate the driving gear 31 clockwise in the drawing, the rotational motion is transmitted from the first driven gear 23 to the platen gear 27 via the shaft 23*a* and the second driven gear 25 so as to rotate the platen 9 backward, i.e., clockwise.

While the backward rotation of the driving gear 31 rotates the first intermittent gear 33 counterclockwise, the pin 33*d* on the first intermittent gear 33 moves in the slot 37*d* on the second intermittent gear 37. Therefore, the rotational motion of the first intermittent gear 33 is not transmitted to the second intermittent gear 37, and accordingly neither the paper feed gear 36 nor the paper feed roller 3 rotates.

As described above, a predetermined amount of the backward rotation of the stepping motor 21 rotates the platen 9 backward and simultaneously suspends the paper feed roller 3. Alternatively, if the stepping motor 21 is rotated backward for more than the predetermined amount, the pin 33*d* on the first intermittent gear 37 abuts on one end portion of the slot 37*d* on the second intermittent gear 37. As a result, the rotational motion is transmitted from the driving gear 31 to the paper feed gear 36, and thus the paper feed roller 3 is rotated backward, i.e., clockwise in the drawing.

When the stepping motor 21 is rotated forward again, the working rod 47*a* of the electromagnetic device 47, which is now de-energized, abuts on the projecting portion 41*a* of the stop cam 41 at its end. Thus, the toothless portion 33*b* of the first intermittent gear 33 is disposed opposite to the driving gear 31, keeping the first intermittent gear 33 in neutral.

Figure 5:
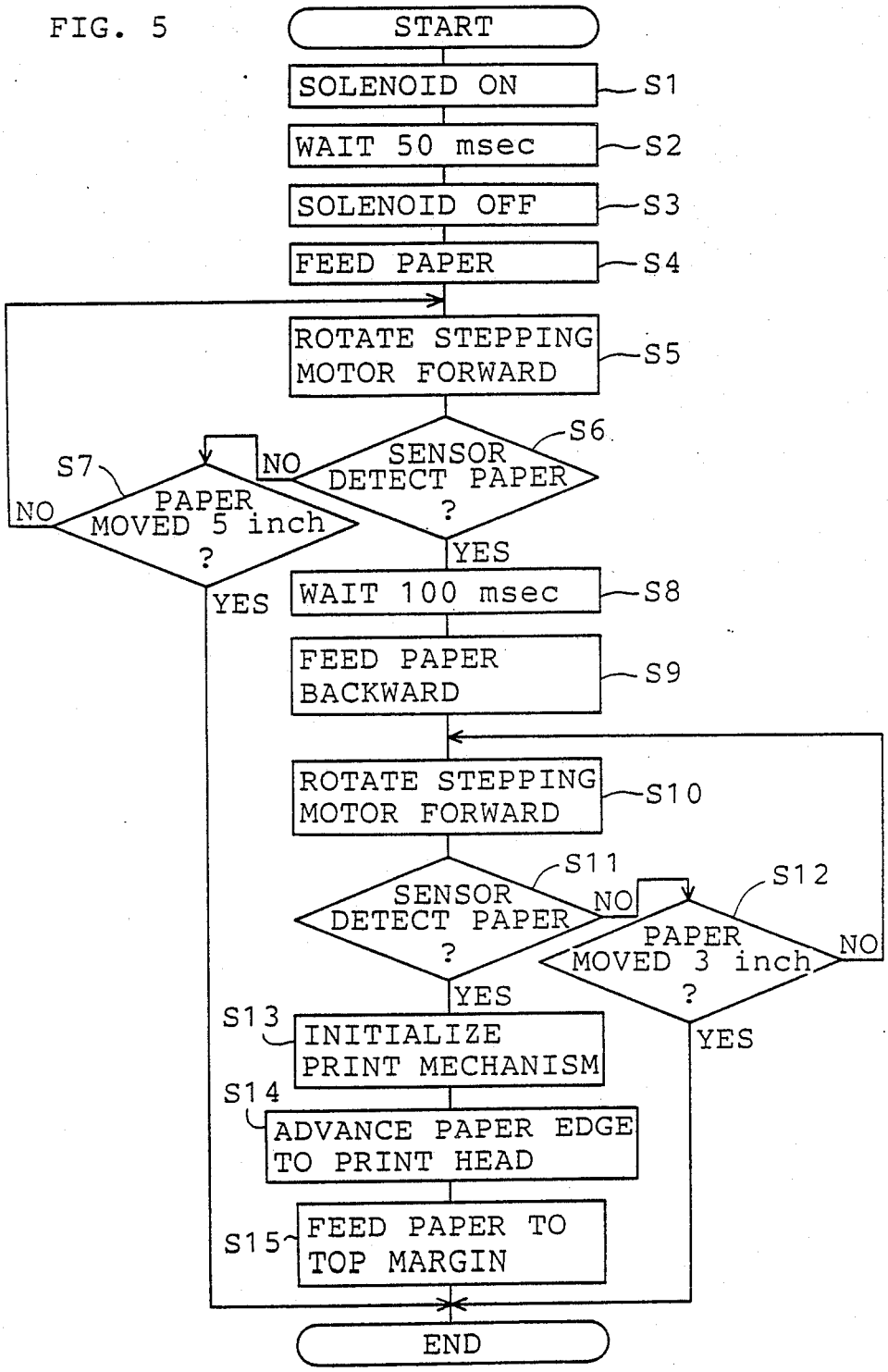
FIG. 5 is a flowchart for explaining the first embodiment of the present invention.

Hereinafter, a paper feed operation will be described according to a flowchart in FIG. 5 which is stored in ROM 55 of the electronic control unit 50.

The routine begins in response to a paper feed command. With the intermittent mechanism in neutral as shown in FIG. 1, the solenoid 47*b* of the electromagnetic device 47 is energized in STEP 1. After STEP 2 waits for 50 msec, STEP 3 de-energizes the solenoid 47*b*. Therefore, as described in detail above, the driving gear 31 engages with the gear portion 33*a* of the first intermittent gear 33 in the intermittent mechanism 30.

In STEP 4 the stepping motor 21 is rotated forward for 132 steps, one step being determined to feed a sheet for 1/48 inch (0.53 mm). The driving gear 31 is then rotated forward as shown by an arrow in FIG. 1. In response to the rotation of the driving gear 31, the paper feed roller 3 is rotated via the first intermittent gear 33, the second intermittent gear 37, and the paper feed gear 36. The rotated roller 3 and the brake roller 5 work together to advance a sheet of paper 2 from the paper feed tray 1 toward the platen 9. On the other hand, the platen 9, in response to the rotation of the driving gear 31, is rotated forward via the first driven gear 23, the second driven gear 25, and the platen gear 27. The platen 9 accordingly advances the sheet 2 whose front edge is already advanced to a position between the rear paper guide roller 11 and the platen 9 by the paper feed roller 3 and the brake roller 5.

Furthermore, the stepping motor 21 is continuously rotated forward to feed the sheet 2 for 1/48 inch in STEP 5 until the paper detective sensor 14 detects the sheet 2 in STEP 6. If STEP 7 determines that the sheet 2 is not detected even after the stepping motor 21 is rotated as much as to advance the sheet 2 for five inches (127 mm), it means that the sheet 2 is not properly supplied yet, and the routine ends here. Therefore, according to the flow from STEP 4 to STEP 7, the platen 9 and the paper feed roller 3 are rotated forward, i.e., counterclockwise in the drawing, so as to feed the sheet 2.

When the paper detective sensor 14 detects the sheet 2 in STEP 6, STEP 8 suspends the rotation of the stepping motor 21 for a predetermined period, which is 100 msec in the present embodiment. This suspension for 100 msec reduces the inertia force of the sheet 2 and the vibration of the platen 9 owing to the platen 9 which comes to a stop after rotation. Thus, the sheet 2 is held between the platen 9 and the rear paper guide roller 11 in contact therewith. Thereafter, STEP 9 rotates the stepping motor 21 backward, as illustrated by FIG. 4B, so as to move the sheet 2 backward for one inch. The platen 9 is rotated backward, while the paper feed roller 3 is suspended since the toothless portions 33*b* and 37*b* of the first and second intermittent gears 33 and 37 are opposite to the driving gear 31 and the paper feed gear 36, respectively, as shown in FIG. 1. As a result, the front edge of the sheet 2 is disposed properly along the platen's longitudinal direction at the rear of the point where the platen 9 is in contact with the rear paper guide roller 11.

After the arrangement of the sheet 2, the stepping motor 21 is continuously rotated forward to feed the sheet 2 for 1/48 inch in STEP 10 until the paper detective sensor 14 detects the sheet 2 in STEP 11. If STEP 12 determines that the sheet 2 is not detected even after the stepping motor 21 is rotated as much as to advance the sheet 2 for three inches (76 mm), it means that the sheet 2 is not properly supplied yet, and the routine ends here. In this case, according to the flow from STEP 10 to STEP 12, the platen 9 and the paper feed roller 3 is rotated forward, i.e., counterclockwise in the drawing, so as to feed the sheet 2.

When the paper detective sensor 14 detects the sheet 2 in STEP 11, STEP 13 initializes the print mechanism by setting the daisy wheel and the carriage to their respective initial positions, and so forth. Thereafter, the stepping motor 21 is rotated as much as 77 steps so as to bring the edge of the sheet 2 to the print head 15 in STEP 14. Furthermore, the sheet 2 is advanced to a preset top margin in STEP 15, and the routine ends here.

According to the above stated embodiment, the stepping motor 21 rotates forward in STEP 4 and STEP 5, and then stops rotating for a predetermined period in STEP 8 prior to the backward rotation in STEP 9. This suspension period can reduce the inertia force of the sheet 2 or the vibration of the platen 9 owing to the stepping motor 21 and the platen 9 which come to a stop after rotation. As a result, the sheet 2, held between the platen 9 and the rear paper guide roller 11 in contact therewith, is moved backward properly in STEP 9 without any trouble such as slipping on the platen 9.

As many apparently widely different embodiments of this invention may be made without departing from the spirit and scope thereof, it is to be understood that the invention is not limited to the specific embodiment thereof except as defined in the appended claims.

What is claimed is:

1. A paper feeder for a printing device having a motor for rotating a platen in normal and reverse direction, a paper feeding roller activated by said motor via an intermittent mechanism for feeding a sheet of paper toward said platen, said intermittent mechanism comprising:

a first intermittent gear rotatably supported on a shaft and having a first gear portion which engages with a drive gear connected to said motor and a toothless portion which does not engage therewith;

a second intermittent gear rotatably supported on the shaft and having a second gear portion which engages with a gear of said paper feeding roller and a toothless portion which does not engage therewith;

engagement means for making an engagement between said first gear portion of said first intermittent gear and said drive gear;

stop means for stopping said first intermittent gear such that said toothless portion thereof and said drive gear are opposed to each other; and rotation means for integrally rotating said first and second intermittent gears when said first intermittent gear is rotated in normal direction, and for rotating at first only said first intermittent gear within a predetermined range and thereafter integrally rotating said first and second intermittent gears when said first intermittent gear is rotated in reverse direction.

2. The paper feeder for the printing device according to claim 1, wherein said rotation means comprises a rod extending from the first intermittent gear and a circumferential aperture provided on the second gear.

3. The paper feeder for the printing device according to claim 1, wherein the engagement means is a spring.

4. The paper feeder for the printing device according to claim 1, wherein the stop means comprises an armature, a solenoid and a spring, the spring being extended upon energization of the solenoid.

5. The paper feeder for the printing device according to claim 1, wherein san end portion of the armature abuts on a cam provided on the second intermittent gear.

6. A paper feeder for a printing device comprising:

a driving roller activated by a motor which rotates in a normal and reverse direction, a press roller in close contact with said driving roller, and control means separate from said driving roller for feeding a sheet of paper toward and away from a printing head, the sheet of paper being held between said driving roller and said press roller in contact therewith, said control means further including waiting means for stopping said motor for a predetermined time period when said rotational direction of said motor is reversed.

* * * * *